US007693684B2

(12) United States Patent
Halbinger et al.

(10) Patent No.: US 7,693,684 B2
(45) Date of Patent: Apr. 6, 2010

(54) PROCESS, SENSOR AND DIAGNOSIS DEVICE FOR PUMP DIAGNOSIS

(75) Inventors: Lorenz Halbinger, Waltershofen (DE); Matthias Hoffmann, Bad Wurzach (DE); Joerg Schuetze, Wasserburg (DE); Daniel Spinnenhirn, Tettnang (DE); Alfred Wagner, Bodnegg (DE)

(73) Assignee: i f m electronic GmbH, Essen (DE)

( * ) Notice: Subject to any disclaimer, the term of this patent is extended or adjusted under 35 U.S.C. 154(b) by 0 days.

(21) Appl. No.: 11/550,038

(22) Filed: Oct. 17, 2006

(65) Prior Publication Data

US 2007/0239371 A1 Oct. 11, 2007

(30) Foreign Application Priority Data

Oct. 17, 2005 (DE) ..... 10 2005 049 900

(51) Int. Cl.
*F04B 49/00* (2006.01)
*G06F 17/40* (2006.01)

(52) U.S. Cl. ..... 702/182; 702/138; 702/140; 702/183; 417/53; 417/63

(58) Field of Classification Search ..... 702/182, 702/34, 114, 140, 183
See application file for complete search history.

(56) References Cited

U.S. PATENT DOCUMENTS 6,030,055 A * 2/2000 Schubert ..... 303/113.4
6,487,903 B2 12/2002 Sabini et al.
6,993,963 B1 * 2/2006 Gudmundsson ..... 73/152.52
7,031,778 B2 * 4/2006 Hsiung et al. ..... 700/29
7,069,183 B2 6/2006 Schluecker et al.
2002/0169582 A1 * 11/2002 Eryurek et al. ..... 702/183
2003/0155672 A1 * 8/2003 Kazmer et al. ..... 264/40.1
2005/0138924 A1 * 6/2005 Kodama et al. ..... 60/456

FOREIGN PATENT DOCUMENTS

| | | | |
|---|---|---|---|
| DE | 4309380 | A1 | 9/1994 |
| DE | 19625947 | C1 | 9/1997 |
| DE | 19738844 | A1 | 4/1999 |
| DE | 298 15 361 | U1 | 2/2000 |
| DE | 19858946 | A1 | 6/2000 |
| DE | 10334817 | A1 | 3/2005 |

* cited by examiner

*Primary Examiner*—Hal D Wachsman
(74) *Attorney, Agent, or Firm*—David S. Safran; Roberts Mlotkowski Safran & Cole, P.C.

(57) ABSTRACT

A process for detecting the operating state of a pump of a pump system, involves the steps of: detecting at least one pressure and/or flow profile P(t) in the pump system, computing of at least one characteristic value $K_{kal}$ from the pressure and/or flow profile P(t), comparing the computed characteristic value $K_{kal}$ with at least one defined characteristic value $K_{vor}$ or with a range bordered by the characteristic value $K_{vor}$, the defined characteristic value $K_{vor}$ or the characteristic value range corresponding to the operating state of the pump of interest, and outputting the operating state determined by the comparison. With the process, the operating states of pumps, pump systems and hydraulic systems is determined by the computed characteristic value $K_{kal}$ characterizing the pulsation of the pressure and/or flow profile P(t) in a computation time interval $\Delta t_B$, the pulsation quotient being computed as the computed characteristic value $K_{kal}$.

12 Claims, 4 Drawing Sheets

PROCESS, SENSOR AND DIAGNOSIS DEVICE FOR PUMP DIAGNOSIS

BACKGROUND OF THE INVENTION

1. Field of the Invention

The invention relates to a process for detecting the operating state of a pump in a pump system, especially a centrifugal or positive displacement pump, with the following process steps: detection of at least one pressure and/or flow profile in the pump system, computation of at least one characteristic value from the pressure and/or flow profile, comparison of the computed characteristic value with at least one defined characteristic value or with a characteristic value range bordered by the characteristic value, the defined characteristic value or the characteristic value range bordered by it corresponding to the operating state of the pump of interest, and output of the operating state determined by the comparison, furthermore a process for detecting the operating state of a device with at least one hydraulic actuator, a sensor for executing the process, a sensor arrangement with a first sensor and with a second sensor and a diagnosis device for detecting the operating state of a pump in a pump system for transport of a liquid delivery medium.

2. Description of Related Art

Pumps are used in industry and research in innumerable and quite different applications, whether in large-scale process engineering systems or, for example, in small laboratory structures with only very small delivery amounts. Failure of a single pump is often associated with failure of the entire system, production shutdown and major costs.

The reasons for damage and failure of a pump are diverse; they are to some extent specific to the pump type used; although, there is a series of general causes which can lead both to adverse effects on centrifugal pumps and also to adverse effects on positive displacement pumps, especially causes which have to do with an unsuitable operating state and the resulting consequent damage to the pump.

One intake-side or low pressure-side cause of an undesirable operating state can be the entrainment of gas into the liquid delivery medium, with the result of the absence of lubrication of the pump parts which come into contact directly with the delivery medium and incipient wear due to the dry friction which then occurs, running hot of bearing ring seals and leaks which lead to backflows and reduced output. To detect gas entrainment, often, there is a sensor in the intake region of the pump for detecting the level in the delivery medium supply line, or the pressure on the outflow or pressure side of the pump is observed and a pressure drop below a minimum value is detected, and the reaction is the shutdown of the pump (see, e.g., German Utility Model DE 298 15 361 U1). The first process has the disadvantage that level measurement cannot detect or can only inadequately detect air bubbles distributed in the delivery medium and the associated gas entry, and conversely, the second process can only be used to detect comparatively large amounts of gas entry, and therefore, is not suited for many applications.

Another frequent problem in pump operation is formation of cavitation in the low pressure region of a pump in which gas bubbles can form within the delivery medium; this can be attributed to the fact that the local pressure within the delivery medium falls below the vapor pressure of the delivery medium. Sudden implosion of cavitations in regions of higher pressure of the delivery medium in the vicinity of pump parts can lead to their erosion as a result of very high, locally limited pulses which are applied, for example, to the impeller blades by the accelerated delivery medium. One known measure for preventing cavitation is to determine the pressure difference between the inflow and outflow side of a pump and to use it to recognize cavitation conditions with consideration of the pump rpm and theoretical delivery height (see, German Patent Application DE 198 58 946 A1). In these and similar processes, the disadvantage is that more and more measurement quantities must always be recorded with several sensors (intake-side and outflow side pressures of the pump, pump rpm) and in addition, special pump characteristics must often be known (for example, NPSH value, net positive suction head); this is associated with major costs.

German Patent Application DE 103 34 817 A1 discloses a process for fault detection in pumps in which the pump pressure is detected by measurement engineering and the pressure profile is subjected to frequency analysis. The amplitude of a single characteristic frequency of the pump is used as the characteristic value from the entire frequency analysis and is compared to a reference amplitude, comparison of the measured and defined amplitude allowing deduction of a fault. The disadvantage in this process is that the choice of only one value from the frequency spectrum of the pressure profile which has been detected by measurement engineering allows only limited information about the actual condition of the operating state of the pump, so that there are only limited possibilities for determination of the operating state of the pump.

German Patent DE 196 25 947 C1 discloses a process for early detection of problems in positive displacement pumps in which the pressure profile is detected by measurement engineering on the pressure side of the pump and the difference of pressure amplitudes in a certain frequency range is determined and used to detect a fault. Here, in turn, the disadvantage is also that, by choosing only a small region of the frequency spectrum which has been obtained from the pressure profile, only limited analysis possibilities of the operating state of the pump are available.

SUMMARY OF THE INVENTION

Therefore, the object of the invention is to provide processes and devices with improved and simplified possibilities for detecting the operating state of pumps, pump systems and hydraulic systems.

The first process according to the invention for detecting the operating state of a pump in a pump system, especially a centrifugal pump or positive displacement pump, in which this object is achieved, first of all, essentially in that the computed characteristic value characterizes the pulsation of the pressure and/or flow profile in a computation time interval, the pulsation quotient being computed as the computed characteristic value.

In contrast to the known processes for detecting the operating state of a pump, the process according to the invention is not limited to detection and evaluation of an individual pressure value—for example, comparison of an individual pressure value with a defined pressure boundary value—but, the process according to the invention takes into account the pressure and/or flow profile as a function of time in the delivery medium at least one point in the pump system and allows the information of interest which can be derived from the pressure and/or flow profile to be included in a computed characteristic value.

According to the invention, it has been found to be especially advantageous when, for detecting the operating state of a pump from the pressure and/or flow profile, a characteristic value is obtained which characterizes the pulsation of the pressure and/or flow profile in a computation time interval. In this respect, it is noted that the delivery flow produced by almost any pump is not exposed to a uniform pressure, but depends on the geometry and physical interaction of the pump elements responsible for accelerating the delivery medium. Even in uniform operation and uniform triggering of the pump, the pressure which is active in the delivery medium and which is caused indirectly by the pump pulses, the pulsating delivery flow and the associated pulsing pressure allowing conclusions, for example, regarding the number of participating pump cylinders in the case of oscillating positive displacement pumps or the number of blade wheels in the case of centrifugal pumps. The resulting pulsation of the pressure profile is characteristic of each pump type, in exactly the same manner as it is characteristic of an individual pump operated in a system, since the pump and system are interacting components of a dynamic system.

It has been recognized according to the invention that the change of pulsation due to unwanted disruptions of the operating state is so strikingly reflected in the pulsation behavior that analysis of pulsation or derivation of a characteristic value from the pulsation of the pressure and/or flow profile is an especially suitable means for identifying these operating states. In accordance with the invention, a pulsation quotient is computed as the computed characteristic value, the pulsation quotient relating the characteristic pressures of the pressure profile and/or flow profile to one another.

Surprisingly, with the process according to the invention, a host of operating states of a pump or pump system can be recognized when the pressure and/or flow profile is determined at only one site in the pump system; according to one especially advantageous configuration of the process according to the invention, this takes place in the vicinity of the outflow region of the pump.

For only slightly compressible delivery media, the pressure active in the delivery medium behaves correspondingly to the flow of the delivery medium, for which reason, here, reference is always made to the pressure and/or flow profile. To some extent, if only the pressure profile is addressed below, this always also implies the alternative use of the corresponding flow profile.

Disruptions and changes of the operating state which can be recognized with the aforementioned process include, in addition to the faults associated with the pump itself (impeller, seal and bearing defects), for example, also volumetric faults in the inflow (for example, due to gas entrainment), faults due to cavitation, changes of system flow resistance and outflow-side blockages, change of material values of the delivery medium which are relevant to flow mechanics (for example, a viscosity change as a result of varying mixing ratios or phase portions or by temperature change), changes in the flow behavior of the delivery medium (for example, by transition from laminar to turbulent flow or by variation of turbulence).

To compute the characteristic value which characterizes the pulsation of the pressure and/or flow profile, the computation time interval should extend at least over one pulsation event, therefore, for example, one pressure and/or flow pulse caused by a blade wheel; but, it is especially advantageous if at least as many pulsation events as correspond to one complete revolution of the pressure- or flow-generating pump elements are used to compute the computed characteristic value.

In one preferred configuration of the process according to the invention, the pulsation quotient is computed as the quotient of the difference of the maximum and minimum delivery medium pressure detected in the computation time interval and an average value of the delivery medium pressure in the computation time intervals. To find the average value, various average values are used, the use of the arithmetic mean being preferred.

Furthermore, the process according to the invention can be improved with respect to its utility by a tolerance band being placed around or on the given characteristic value, the value range defined by the tolerance band then being defined by a lower given characteristic value and/or an upper given characteristic value. When the given characteristic value describes the proper operating state of the pump, the tolerance band thus defines an accepted operating state range, and the comparison of each computed characteristic value with the given characteristic value range defined by the tolerance band provides information on whether the pump is being operated in an allowable operating state or not. In this connection, it has been found to be especially advantageous if the tolerance band symmetrically surrounds the given characteristic value, the lower given characteristic value and the upper given characteristic value, therefore, being spaced equally far from the given characteristic value.

The process is then configured especially practicably when the defined characteristic value at the start of the process is determined within a teaching time interval, the pump being in the operating state of interest during the teaching time interval, this operating state of interest ideally being a fault-free operating state so that the pump and pump system need not be operated specifically in an operating state which may then damage the pump over the long term for teaching. This teaching of a good state should be carried out especially easily for the user, as experience shows, with the advantage that the given characteristic value is ideally adapted to the pump or pump system.

The described process using the pulsation quotient as a computed and given characteristic value surprisingly turned out to be especially well suited to recognizing and distinguishing from one another very different operating states for different pump types. By using the process, very small input-side volumetric faults can be detected, such as, for example, very small entrained amounts of gas or only slightly incipient cavitation, so that monitoring the pump state with the process according to the invention allows the pump and pump system state to be influenced long before the actual damage can start.

The process is likewise suited to recognizing an output-side blockage which ordinarily can only be recognized with difficulty in centrifugal pumps. These faults under certain circumstances are therefore difficult to recognize because centrifugal pumps with uniform pump rpm do not impose a volumetric flow against such a high resistance on the connected system, as is the case in positive displacement pumps. This leads to the output-side blockage of the pumps or pump system in centrifugal pumps not having to lead to a significant increase of the mean delivery medium pressure, the mean pressures prevailing on the output side on the delivering pump can hardly be distinguished from one another in the normal operating state and in the case of a blockage. Conversely, in the case of a blockage, the pulsation of the pressure profile changes; this is reflected in a change of the pulsation quotient which can be evaluated. This explains the special suitability of the process for detecting blockage states in centrifugal pumps.

An output-side increase of the flow resistance or even a blockage in positive displacement pumps appears completely differently with respect to the outflow-side pressure profile, specifically leads to an extremely steep rise of the delivery medium pressure to very high pressure values.

To detect blockage-like operating states, in another process in accordance with the invention, the computed characteristic value is selected such that the computed characteristic value characterizes the time change of the pressure and/or flow profile, especially by computing the difference quotient of successively measured delivery medium pressures and/or flows, the given characteristic value defining a maximum/minimum time change of the pressure and/or flow profile, especially the given characteristic value being defined for a certain pressure and/or flow region of the delivery medium pressure.

"Successively measured delivery medium pressures" are defined here as the pressure profile in real technical systems being detected, not continuously in time, but by a sampling process. In this respect, the successively measured delivery medium pressures are instantaneous recordings of the delivery medium pressure obtained in a time-discrete sampling process. By finding the difference quotient—therefore, the quotient of the difference of the currently obtained pressure value and of the pressure value of the delivery medium obtained beforehand and the time interval which lies between the two data collections—the rate of change of the delivery medium pressure can be deduced.

The fault case of an output-side blockage in the flow profile can be detected so early according to the described teaching of the invention that the pump can be turned off as a result of the detected blockage state so early that bypass valves are no longer necessary for isolation of a bypass line connected to the input side of the pump, by which sudden pressure fluctuations in the pump and pump system can be avoided.

If the rate of change or the amount of the rate of change of the delivery medium pressure is above a given characteristic value, it is assumed that as the pump continues to operate an unallowable pressure value in the delivery medium and thus in the system will presumably be reached. In the detection of this operating state, triggering of the pump can be predictively affected so that reaching impermissible pressure values within the pump system can be avoided in time.

The process based on the rate of change of the pressure and/or flow profile can be used especially advantageously when the detection of a harmful pressure rise is linked not only to the value of the pressure rise itself, but to the level of the absolute pressure and absolute flow velocity. Thus, a rapidly changing pressure—proceeding from a low absolute pressure value—can be noncritical, but, conversely, the same rate of change of the pressure at the already reached higher pressure can indicate a harmful operating state which occurs with higher probability and which makes it necessary to immediately turn off the pump.

According to another independent teaching of the invention, the object of the invention is further achieved by a process for detecting the operating state of a device with at least one hydraulic actuator in that, first of all, the pressure profile in the hydraulic actuator or the feed line to the hydraulic actuator is detected, according to which a comparison of the measured pressure profile with at least one defined pressure profile and/or comparison of at least one computed characteristic value which characterizes the measured pressure profile to at least one corresponding defined characteristic value which characterizes the defined pressure profile is performed, and afterwards, the operating state determined by the comparison is output. This process in accordance with the invention is based on the finding that, not only can the pressure features proceeding from the drive assembly and characterizing the hydraulic drive assembly be transported by the delivery medium or hydraulic medium, but also the corresponding features of the assembly or actuator operated by the hydraulic medium.

The features can be, for example, mechanical reactions which the actuator undergoes by interaction with its environment and which propagate in the hydraulic medium. The actuator can be, for example, the drive of a machine tool which interacts mechanically via the driven tools with a workpiece to be machined, by which corresponding pressure profiles propagate into the hydraulic delivery medium, which can be evaluated similarly to the case of signals which go back to the operating states of pumps. Either a defined pressure profile recorded in the fault-free state can be compared directly to the measured pressure profile, or an indirect comparison is performed by determining a characteristic value from the defined and measured pressure profile and by subjecting the characteristic values to comparison.

Precise quality monitoring can be performed by detection of characteristic pressure profiles or by determining the characteristic values from the pressure profiles in the hydraulic feed lines of an actuator with very low hardware costs, for example, in the area of forming technology (punching, bending, deep-drawing, edging), but direct utilization of the acquired information is also possible for influencing control when the process in accordance with the invention is carried out under real time conditions. In the area of metal-cutting production processes, which are often accompanied by heavy loading of machinery and machining tools, the process is suited not only for quality assurance (for example, detection of a chattering in-feed) but also for early detection of tool problems, such as overloading of drills, files and milling heads which inevitably lead to their damage or failure.

In one preferred configuration of this process, the characteristic values computed from the measured and the defined pressure profile are parameters obtained from a vibration analysis, especially parameters obtained from Fourier analysis. In another embodiment, correlation processes are used for comparison of the pressure profiles.

The processes in accordance with the invention are configured in one preferred embodiment such that, depending on at least one influencing variable, not only one characteristic value, but several, especially different, characteristic values are defined. These characteristic values can be constant in regions, they can form defined characteristic values-characteristic curves, and they can also form characteristic values-performance data, especially when the defined characteristic values are dependent on several influencing variables. This measure easily makes it possible to use the processes in accordance with the invention in quite different operating ranges of pumps, pump systems and hydraulic systems with actuators. This is especially possible when the influencing variable is a state variable of the pump, the pump system and/or a device with a hydraulic actuator, for example, rpm, solid-borne noise, temperature, flow, etc.

Alternatively or in addition, in one preferred configuration of the process in accordance with the invention, it is also possible to use definable external influencing variables which can originate, for example, from external triggering. This has the advantage, for example, that even for extreme state changes—as in starting and stopping a pump, pump system or hydraulic actuator—there can be reactions on the changing boundary conditions of operation and monitoring of the operating state need not be abandoned. The latter is the case in known systems which are turned off in hard transient processes or which are deactivated at that time; this does not lead to shutoff of the pump, pump system or hydraulic actuators. Nevertheless, this is accompanied by a temporary loss of observation and monitoring of the system in these sensitive operating states.

According to a further independent teaching of the invention, the object of the invention is achieved by a sensor for executing the aforementioned processes, a measurement and evaluation rate being attainable with the sensor that is at least twice as high, preferably at least five times as high, as the reciprocal of the time constant of the fastest pressure and/or flow profile of interest. Therefore, if processes in the pressure and/or flow profile are to be recognized which take place in the range of 10 ms, it is advisable to study the processes with a sensor which implements sampling rates in the ms range. In one advantageous embodiment of the sensor in accordance with the invention, measurement and evaluation rates which are at least 1 kHz, preferably at least 8 kHz, can be achieved with the sensor.

In an especially preferred configuration of the invention, the sensor is an overload-proof or high pressure-proof pressure sensor which has a ceramic-capacitive pressure measurement cell; for example, this is especially advantageous in the case in which the operating state of the positive displacement pump is being observed, in which far greater pressures can occur very quickly than can be recorded by a pressure sensor designed for normal operation or can be converted into corresponding signals.

The sensor in accordance with the invention is also preferably equipped with a data interface via which the detected operating state can be output and/or via which the sensor can be parameterized or via which external data, such as, for example, measurement or evaluation data of another sensor, can be communicated to the sensor.

Alternatively or in addition, the sensor has a switching output which can be switched when the operating state is detected, by which emergency circuits can be implemented especially easily.

In an especially preferred embodiment of the sensor in accordance with the invention, the measurement cell of the sensor has an exciter element which is able to generate pressure waves in the delivery medium, to the extent that the sensor is surrounded by the delivery medium. Thus, it is possible, in addition to passive pressure measurement, to actively emit signals (pressure waves) into the delivery medium, and for example, to obtain information about the delivery medium and the environment filled at least partially by the delivery medium using reflected pressure waves. In addition to the pure pressure information, level information or flow information based on the propagation time principle can thus be obtained.

In a preferred embodiment of the sensor, the exciter element is located on the pressure measurement cell of the sensor or the membrane of the pressure measurement cell forms the exciter element itself. In this way, very compact models can be built. Technically, the sensor is preferably implemented with an electromechanical exciter element based on the piezo effect or with a piezo membrane.

In another embodiment of the sensor, the sensor has an exciter element spaced apart from its measurement cell, especially an electromechanical exciter element based on the piezo effect, the exciter element being especially fixed on a clip of the sensor. Adulteration of the measurement by deposits can be prevented or at least hindered by the spacing of the exciter element, since deposits settle more easily on large-area structures than on small structures, such as, for example, the exciter element fixed on a small clip. This construction has the additional advantage that the pressure sensor of the sensor can be easily calibrated and zero point balancing of the pressure sensor or the pressure measurement cell is easily possible, since defined pressure signals can be generated via the exciter element and the exciter element is not directly connected to the pressure measurement cell.

According to another configuration, an exciter element is assigned to the sensor, especially an electromechanical exciter element based on the piezo effect, the exciter element being movable relative to the sensor. In contrast to the above described sensors with an exciter element on or in the sensor, the exciter element is flexibly movable, here, relative to the actual sensor. The exciter element is, so to speak, an external satellite of the sensor and acts as a signal source, as in the other cases. Therefore, in this approach, the level or flow can be directly monitored without the signals emitted by the exciter element having to be reflected on adjacent surfaces. The assigned exciter element is connected via at least one data channel to the sensor, and the data channel can be made especially electrical, optical or electromagnetic; the exciter element can therefore have its own power supply, assignment can exist solely in a coded data link.

The exciter elements of the sensors are preferably operated such that they emit ultrasonic waves in the excited state.

According to another independent teaching of the invention, the object in accordance with the invention is achieved with a sensor arrangement with a first sensor and a second sensor with one exciter element each, the sensors being arranged spaced apart from one another in a pump, a pump system, or a device with at least one hydraulic actuator and the exciter element of the first sensor and the exciter element of the second sensor emitting waves in the delivery medium which are received by the first and/or second sensor, the flow velocity of the delivery medium being determined via evaluation of the propagation time differences of the emitted waves in the delivery direction and against the delivery direction.

In the sensor arrangement, preferably, either two sensors with exciter elements integrated into the sensor are used or sensors with exciter elements which can be moved by the sensor element are used. In the former case, the waves emitted by the exciter element of the first sensor are received by the second sensor, and conversely the waves emitted by the exciter element of the second sensor are received by the first sensor. In the latter case, each exciter element assigned to a sensor emits exactly the waves which are received by the assigned sensor of the exciter element.

The object in accordance with the invention is furthermore achieved with a diagnosis device which is equipped for detecting the operating state of a pump in a pump system for transport of a liquid delivery medium or for detection of the operating state of a hydraulic actuator with a first sensor for detection of the pressure and/or flow profile within the delivery medium, as has been described above, and moreover, is equipped with a second sensor, the data which are to be made available from outside and which are conventionally necessary for operation of the second sensor being provided at least partially by the first sensor and/or the data which are to be made available from outside and which are conventionally necessary for operation of the first sensor being provided at least partially by the second sensor.

The above described configuration of the diagnosis device in accordance with the invention is advantageous in many respects, for example, because at least one data source can be saved, specifically the one which previously had to be provided externally to supply the first sensor and/or the second sensor. In this way, major savings effects can be achieved with simultaneously improved diagnosis possibilities.

In one preferred configuration of the diagnosis device in accordance with the invention, the second sensor is a vibration sensor for detecting the solid-borne vibrations of the system, especially those solid-borne vibrations which are not relayed or are relayed only poorly via the liquid delivery medium. Thus, especially those state data of the pump are determined which identify, for example, the wear in the bearings used in the pump.

The data which are to be made available from outside and which are necessary for operation of the second sensor can, on the one hand, be measurement data which are provided to the second sensor especially via an analog, digital or also manual interface. A manual interface is defined here as an operating interface (for example, film keyboard) of the device via which, for example, certain characteristic data can be input.

The data which are to be made available externally can be, for example, the rpm of the pump used in the pump system. The rpm of the pump can be determined by a first sensor of the diagnosis device which is made as a pressure sensor, if, in the case of a centrifugal pump, the number of blade wheels is known and the pulsation of the pressure profile is determined using the first sensor which is made as a pressure sensor.

In another preferred configuration of the diagnosis device in accordance with the invention, the measurement and operating state data obtained from the first sensor are used in support of the evaluation of the measurement data obtained from the second sensor, and/or the measurement and operating state data obtained from the second sensor are used in support of the evaluation of the measurement data obtained from the first sensor. In this way, a further synergy effect can be achieved since, by combination of the data obtained separately from the two sensors, an especially accurate and high quality determination of the operating state of the pumps is possible, as would not be possible by using only the data obtained from the first sensor or only the data obtained from the second sensor. This is especially easily imaginable for the case in which the measurement data obtained from the first and second sensors are used for alternating elimination of mutual influence, for example, on the one hand, by filtration of unwanted influences of the pressure and flow profile recorded by the first sensor on the solid-borne vibration detected by the second sensor, and/or on the other hand, of the solid-borne vibration detected by the second sensor on the pressure and flow profile detected by the first sensor.

In particular, there are a host of possibilities for embodying and developing the process in accordance with the invention, the sensor in accordance with the invention and the diagnosis device in accordance with the invention. In this respect reference is made to the following description in conjunction with the accompanying drawings.

DETAILED DESCRIPTION OF THE INVENTION

Figure 1:
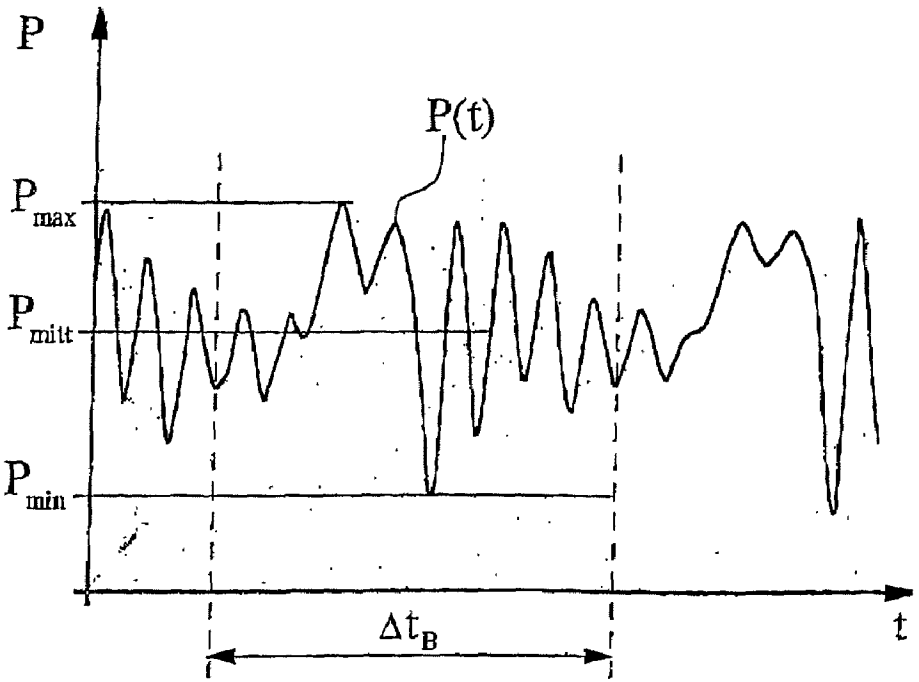
FIG. 1 is plot of the detected pressure profile within the delivery medium of a pump system in accordance with the invention for explanation of the process.
Figure 2:
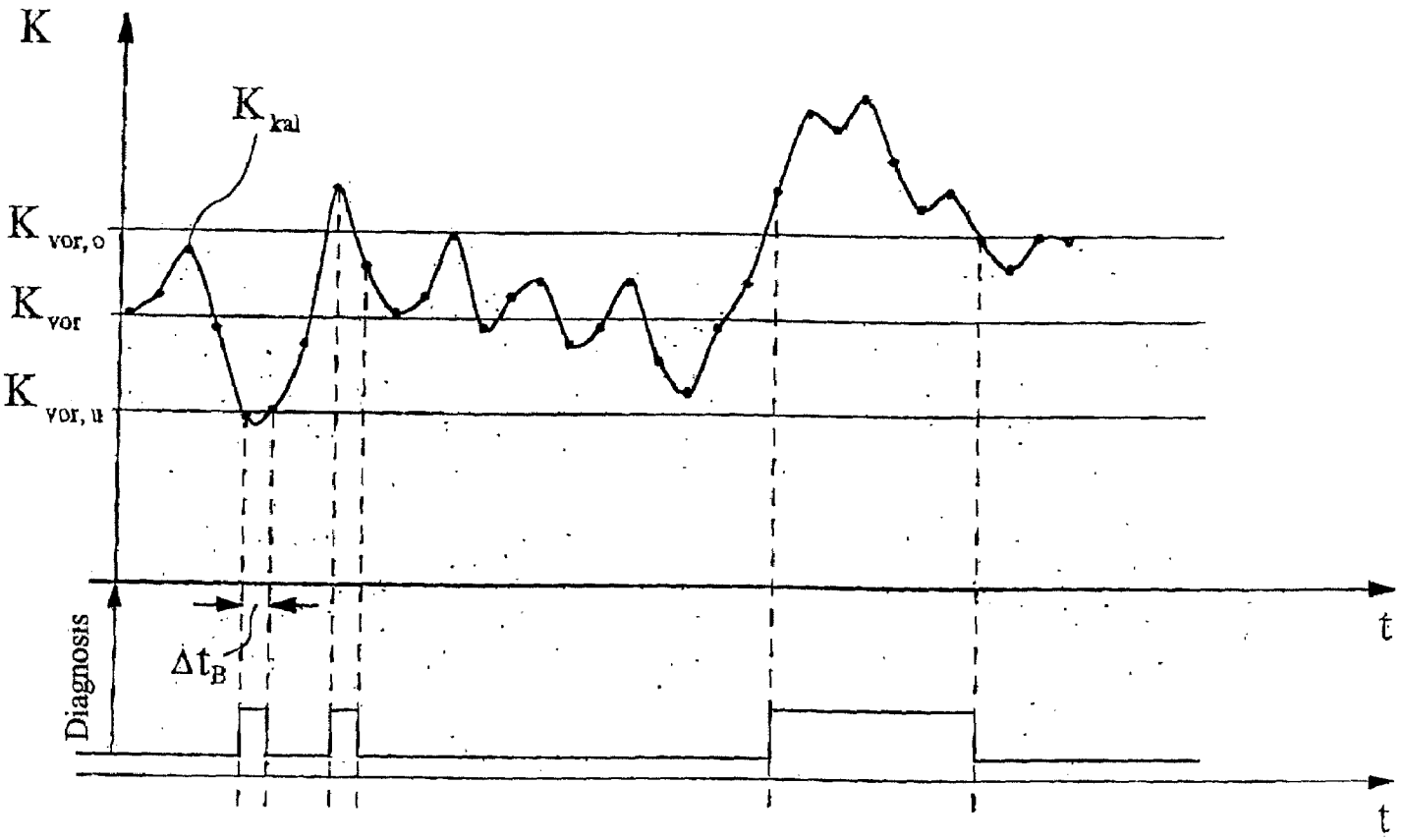
FIG. 2 is a graph for explanation of a preferred embodiment of a process in accordance with the invention.

One embodiment for executing a first process in accordance with the invention is explained, first of all, using FIGS. 1 and 2.

FIG. 1 shows a pressure profile P(t) which was detected in a first process step and which was recorded in the delivery medium at a point in the outflow region of a pump operated in a pump system. The pressure profile P(t) is characteristic of the pump operated in the pump system and allows conclusions regarding the type and certain structural properties of the pump and also the operating state in which the pump is found.

FIG. 2 shows that, in the second process step, characteristic values $K_{kal}$ are obtained from the pressure profile P(t) according to a computation rule which is explained in detail below. The detected pressure profile P(t) is conventionally not a profile which is continuous in time, but an arrangement of many measurement points obtained by time-discrete measurement in a row. Beyond the time pressure profile P(t), in successive computation time intervals $\Delta t_B$, characteristic values $K_{kal}$ are computed; this is illustrated in FIG. 2 by points on the solid curve. After each computation time interval $\Delta t_B$, based on the detected pressure profile P(t), a new characteristic value $K_{kal}$ is computed and compared to a defined characteristic value $K_{vor}$, the defined characteristic value $K_{vor}$, corresponding to the operating state of the pump of interest. By comparison of the location of the computed characteristic value $K_{kal}$ to the defined characteristic value $K_{vor}$, the operating state can consequently be determined in which the pump is currently found, the operating state in each computation time interval $\Delta t_B$, being reevaluated and output in another process step; this is indicated in FIG. 2 by the bottom diagram labeled "diagnosis".

The pressure profile P(t) shown in FIG. 1 was produced by a centrifugal pump and the pulsation of the pressure profile P(t) to be detected among others goes back to the action of each individual blade wheel of the centrifugal pump. The illustrated pressure profile is not shown to scale, and it is intended simply to describe the fundamentally observable conditions.

The characteristic values $K_{kal}$ computed in the illustrated embodiment of the process in accordance with the invention characterize the pulsation of the pressure of the pressure profile P(t) in the computation time interval $\Delta t_B$, the computation time interval $\Delta t_B$ in this embodiment encompassing so many pulsation events which correspond to a complete revolution of the pressure-generating pump elements, in this case, one complete revolution of the blade wheel of the centrifugal pump. The computed characteristic values $K_{kal}$ shown in FIG. 2 characterize the pulsation of the pressure profile P(t) shown in FIG. 1 as the pulsation quotient. To compute the pulsation quotient, the quotient of the difference of the delivery medium pressure which is maximum and minimum ($P_{max}-P_{min}$) in the computation time interval $\Delta t_B$ and a mean value $P_{mitt}$ of the delivery medium pressure is computed, which thus relates the maximum deflection of the pressure profile P(t) to the pressure $P_{mitt}$ present on average. In this process, the arithmetic mean is used as the average value.

The defined characteristic value $K_{vor}$ can be defined as such for the process, in this case, the defined characteristic value $K_{vor}$, however, is determined by teaching within the teaching time interval. In this process, the defined characteristic value $K_{vor}$ like the computed characteristic value $K_{kal}$ is determined at the start of the process during the teaching time interval, the pump being found in the fault-free operating state during the teaching time interval. The teaching time interval comprises several computation time intervals $\Delta t_B$ in order to achieve better smoothing. In another configuration of the process, not shown here, several defined characteristic values $K_{vor}$ are determined in several teaching time intervals, the several defined characteristic values $K_{vor}$ obtained in this way then being combined by averaging into a single defined characteristic value $K_{vor}$.

Figure 3:
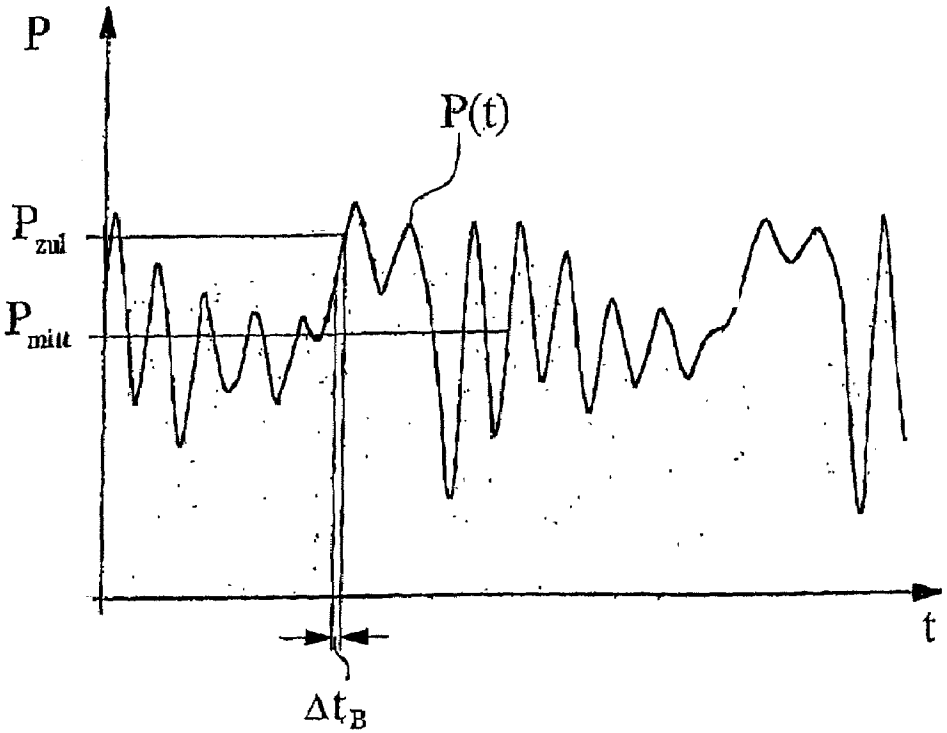
FIG. 3 is a plot of the pressure profile in a pump system for illustrating another embodiment of the process in accordance with the invention.

FIG. 3 shows the situation in the computation of the other characteristic value $K_{kal}$ from the detected pressure profile P(t) which characterizes specifically the time change of the detected pressure profile P(t). In this process, the characteristic value $K_{kal}$ is determined by computing the different quotient of successively measured delivery medium pressures. Accordingly, the defined characteristic value $K_{vor}$ (not shown here) defines the maximum time change of the pressure profile P(t); this is important especially in the operation of positive displacement pumps, especially when outflow-side blockages of the pump or pump system are to be detected and avoided.

In the process shown in FIG. 2, a tolerance band has been placed around the defined characteristic value $K_{vor}$ so that a lower defined characteristic value $K_{vor,u}$ and an upper defined characteristic value $K_{vor,o}$ result, the tolerance band symmetrically surrounding the defined characteristic value $K_{vor}$ in this case. In a comparison of the computed characteristic values $K_{kal}$ according to the process to the tolerance band of an accepted and allowable operating state of the pump defined by the stipulated characteristic values $K_{vor,o}$ and $K_{vor,u}$, it can therefore be established whether the pump is possibly endangered or not. In the process shown in FIG. 2, each time the tolerance band is exceeded or not reached is indicated by output of a diagnosis signal.

It is conceivable that each time the tolerance band is exceeded by the computed characteristic value $K_{kal}$, a fault signal need not necessarily be immediately output, for example, in order to avoid an oversensitive reaction of the process. For this purpose, in one especially preferred embodiment of the process, it is provided that the behavior of the computed characteristic value $K_{kal}$ is smoothed by computing the sliding weighted arithmetic mean. In an especially preferred configuration of this weighted arithmetic mean determination, the currently computed characteristic value $K_{kal}$ is weighted once and the characteristic value $K_{kal}$ computed beforehand is weighted with a factor 1 to 10 so that only when the tolerance band or the defined characteristic value $K_{vor}$ is exceeded or not reached to a significant degree or repeatedly to a slight degree is a fault signal generated.

In another preferred embodiment which is not shown here, a deviation of the computed characteristic value $K_{kal}$ from the defined characteristic value $K_{vor}$ is indicated not only by a binary signal—deviation present or absent—but the degree of deviation is also made clear.

In the process shown in FIG. 2, the distance of the lower defined characteristic value $K_{vor,u}$ and the distance of the upper defined characteristic value $K_{vor,o}$ each correspond to 50% of the defined characteristic value $K_{vor}$.

Figure 4:
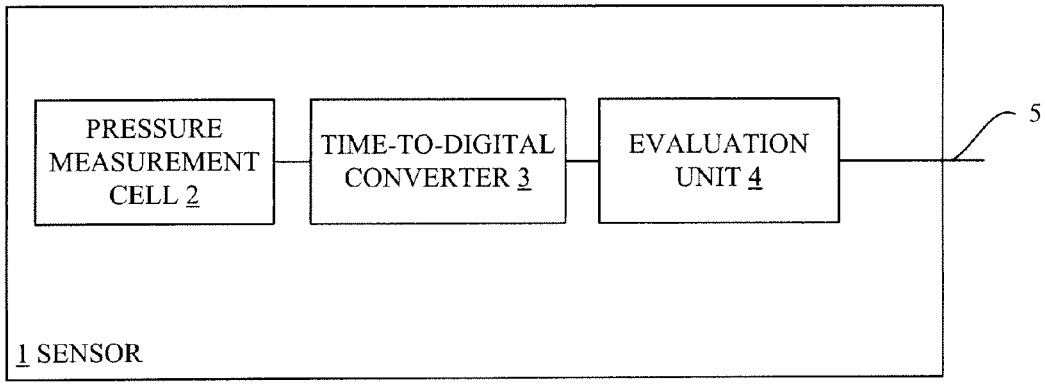
FIG. 4 is a schematic of a sensor in accordance with the invention.

FIG. 4 shows in a schematic one embodiment of the sensor 1 in accordance with the invention for carrying out the above described process. With the sensor 1, a measurement and evaluation rate can be achieved which is five times higher than the reciprocal of the time constant of the fastest pressure profile P(t) of interest. In the embodiment shown in FIG. 4, the sensor 1 is a pressure sensor with a sampling rate of 8 kHz. The sensor 1 has a ceramic-capacitive pressure measurement cell 2 which is resistant to high pressure and overload, specifically has an attachable membrane which itself is supported at very high pressure loads on the base of the pressure measurement cell 2 such that destruction or alteration of the measurement behavior of the pressure measurement cell 2 is avoided. The capacitance of the pressure measurement cell 2 is determined using the principle of time-to-digital conversion by an integrated time-to-digital converter 3 and is converted by the evaluation unit 4 into a corresponding pressure value.

The pressure sensor 1 as shown in FIG. 4 also has a data interface 5 via which the detected operating state can be output, the data interface binary switching output being switched when the operating state is recognized, and moreover, an analog output is provided via which different operating states can be made recognizable on a differentiated basis. Another embodiment of a sensor in accordance with the invention, not shown here, conversely, has a data interface 5 with a serial interface protocol.

In another preferred embodiment of the sensor 1 which is, however, not shown here, the sensor 1 additionally comprises a display unit for displaying the operating state or alternatively for displaying the deviation from an operating state.

In another embodiment of the sensor in accordance with the invention which is not shown, data can also be delivered to the sensor 1 from externally via the data interface 5, for example, analog and/or digital data.

Figure 5:
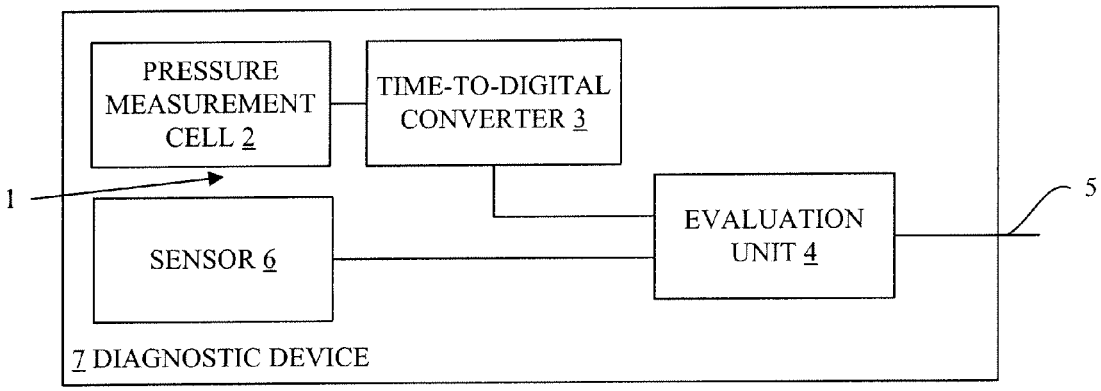
FIG. 5 is a schematic of a diagnosis device in accordance with the invention.

FIG. 5 shows an embodiment of a diagnosis device 7 in accordance with the invention for detecting the operating state of a pump in a pump system for transport of a liquid delivery medium or for detecting the operating state of a device with at least one hydraulic actuator (hereinafter called only the operating state), with a first sensor 1 for detecting the pressure profile within the delivery medium or the hydraulic medium, the sensor 1 being a version of the sensor 1 described above in FIG. 4. The diagnosis device 7 has a second sensor 6, the data from which can be made available externally and which are conventionally necessary for operation of the second sensor 6 being made available at least partially by the first sensor 1, and the data which can be made available from externally and which are conventionally necessary for operation of the first sensor 1 being made available at least partially by the second sensor 6. This combination of the first sensor 1 and the second sensor 6 allows major cost savings compared to a diagnosis device which is composed of two separate sensors 1 and 6.

In the embodiment shown in FIG. 5, the second sensor 6 is a vibration sensor for detecting the solid-borne vibrations of the system. Advantageously, on the diagnosis unit 7 shown in FIG. 5, it is not only that the data required by the first sensor 1 can be delivered at least partially by the second sensor 6 and vice versa, but it is also advantageous for the diagnosis unit 7 to use only a single, common evaluation unit 4, by which other major savings can be achieved compared to a simple combination of two separate sensors, especially when it is considered that the evaluation unit 4 in view of the necessary computations is a comparatively expensive digital signal processor.

Another advantage of the diagnosis unit 7 in accordance with the invention is that the measurement and operating state data obtained from the first sensor 1 are used in support of the evaluation of the measurement data obtained from the second sensor 6, and the measurement and operating state data obtained from the second sensor 6 are used in support of the evaluation of the measurement data obtained from the first sensor 1. In the illustrated embodiment, the solid-borne vibrations detected by the sensor 6 or their influence on the pressure profile P(t) detected by the first sensor 1 are filtered out of this pressure profile P(t) so that, by using the diagnosis unit 7, a "cleaner" pressure profile P(t) can be determined than would be possible solely by using an individual pressure sensor. Conversely, in the illustrated diagnosis unit 7, the effect of the pressure profile P(t) on the solid-borne vibrations detected by the second sensor 6 is also calculated out of the detected solid-born vibrations so that, overall, a sharper assessment of the operating state is possible and unwanted operating states can be more reliably detected than when using two separate sensors.

In another embodiment of the diagnosis unit 7 in accordance with the invention which is not shown, the diagnosis unit 7 additionally comprises a display and input unit via which the determined operating states can be displayed and the diagnosis unit 7 can be parameterized.

Finally, two important aspects will be addressed.

On the one hand, mainly pumps were the topic above, therefore active pulsation exciters. However, the teachings of the invention can also be easily used when also or only passive pulsation exciters are present, both those with parts in contact with the medium which cannot move, and also those which have parts which are moved solely by the flowing medium and/or by its pressure fluctuations, for example, diaphragms, throttles, valves and flaps.

On the other hand, the teachings of the invention also include determined operating states being output, for example, via a switching output. In this connection, it can be additionally provided, as is also included among the teachings in accordance with the invention, that hysteresis, under certain circumstances a considerably high hysteresis, is implemented so that at a certain detection value the switching output turns on (or off), but only turns off (or on) again at a smaller, under certain circumstances a much smaller detection value.

What is claimed is:

1. Process for detecting the operating state of a pump in a pump system, comprising the steps of:

detecting at least one of a pressure and a flow profile P(t) in the pump system, computing at least one characteristic value $K_{kal}$ of the at least one of the pressure and flow profile P(t), determining the operating state of the pump by comparing the at least one computed characteristic value $K_{kal}$ with at least one of a predefined characteristic value $K_{vor}$ and a characteristic value range bordered by the characteristic value $K_{vor}$, and outputting the operating state of the pump determined by the comparison, wherein the at least one computed characteristic value $K_{kal}$ characterizes a pulsation of at least one of the pressure and flow profile P(t) in a computation time interval $\Delta t_B$, a pulsation quotient being computed as the at least one computed characteristic value $K_{kal}$.

2. Process as claimed in claim 1, wherein the at least one of the pressure and flow profile P(t) is detected in the vicinity of the outflow region of the pump.

3. Process as claimed in claim 1, wherein the computation time interval $\Delta t_B$ encompasses at least as many pulsation events correspond to one complete revolution of the pressure-generating elements of the pump.

4. Process as claimed in claim 1, wherein the pulsation quotient is a quotient of the difference of at least one of a maximum and minimum delivery medium pressure and a flow which has at least one of pressure and flow in the computation time interval $\Delta t_B$.

5. Process as claimed in claim 1, wherein the predefined characteristic value $K_{vor}$ is determined at the start of the process within a teaching time interval, the pump being in an operating state of interest during the teaching time interval.

6. Process as claimed in claim 1, wherein the behavior of the at least one computed characteristic value $K_{kal}$ is smoothed by computing a sliding weighted arithmetic mean beforehand.

7. Process as claimed in claim 1, wherein, depending on at least one influencing variable, different characteristic values $K_{vor}$ are defined.

8. Process as claimed in claim 7, wherein the at least one influencing variable is a state variable of at least one of the pump and the pump system.

9. Process for detecting the operating state of a pump in a pump system, comprising the steps of:

detecting at least one of a pressure and a flow profile P(t) in the pump system, computing at least one characteristic value $K_{kal}$ of the at least one of the pressure and flow profile P(t), determining the operating state of the pump by comparing the at least one computed characteristic value $K_{kal}$ with at least one of a predefined characteristic value $K_{vor}$ and a characteristic value range bordered by the characteristic value $K_{vor}$ and outputting the operating state of the pump determined by the comparison, wherein the at least one computed characteristic value $K_{kal}$ characterizes a time change of at least one of the pressure and the flow profile P(t), the characteristic value $K_{vor}$ defining a maximum/minimum time change of the at least one of the pressure and the flow profile P(t).

10. Process as claimed in claim 9, wherein a tolerance band is placed around the characteristic value $K_{vor}$ so that at least one of a lower predefined characteristic value $K_{vor,u}$ and an upper predefined characteristic value $K_{vor,o}$ results.

11. Process as claimed in claim 10, wherein the distance of at least one of the lower predefined characteristic value $K_{vor,u}$ and the distance of the upper predefined characteristic value $K_{vor,o}$ to the predefined characteristic value $K_{vor}$ corresponds to 10 to 90% of the predefined characteristic value $K_{vor}$.

12. Process for detecting the operating state of a device with at least one hydraulic actuator, comprising the steps of:

detecting a pressure profile P(t) in one of the at least one hydraulic actuator and a feed line to the at least one hydraulic actuator, comparing the detected pressure profile P(t) with a predefined pressure profile $P_{vor}(t)$ and comparing at least one computed characteristic value $K_{kal}$ which characterizes the detected pressure profile P(t) to at least one corresponding characteristic value $K_{vor}$ which characterizes the predefined pressure profile $P_{vor}(t)$, outputting an operating state of the device determined by the comparison, and wherein the characteristic values $K_{kal}$ and $K_{vor}$ computed from the detected and the predefined pressure profiles are based on a vibration analysis.

* * * * *